US011250774B2

(12) United States Patent
Kang et al.

(10) Patent No.: US 11,250,774 B2
(45) Date of Patent: Feb. 15, 2022

(54) DISPLAY DEVICE AND DRIVING METHOD THEREOF

(71) Applicant: Samsung Display Co., Ltd., Yongin-Si (KR)

(72) Inventors: Bong Gyun Kang, Suwon-si (KR); Kyun Ho Kim, Yongin-si (KR); Sung-Mo Yang, Hwaseong-si (KR); Young Soo Sohn, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/021,971

(22) Filed: Sep. 15, 2020

(65) Prior Publication Data

US 2021/0256904 A1 Aug. 19, 2021

(30) Foreign Application Priority Data

Feb. 19, 2020 (KR) ..... 10-2020-0020565

(51) Int. Cl.
*G09G 3/3225* (2016.01)

(52) U.S. Cl.
CPC ... *G09G 3/3225* (2013.01); *G09G 2320/0257* (2013.01); *G09G 2320/0626* (2013.01); *G09G 2330/027* (2013.01); *G09G 2330/04* (2013.01)

(58) Field of Classification Search
CPC ..... G09G 3/3225; G09G 2330/04; G09G 2320/0257; G09G 2320/0626; G09G 2330/027; G09G 3/3208; G09G 2320/043; G09G 2330/045; G09G 2330/021; G09G 3/3233; G09G 2320/046; G09G 3/3258
See application file for complete search history.

(56) References Cited

U.S. PATENT DOCUMENTS

2015/0371601 A1* 12/2015 Kim ..... G06F 1/28 345/212
2017/0309246 A1* 10/2017 Lee ..... G09G 3/3666

FOREIGN PATENT DOCUMENTS

KR 10-2015-0081867 A 7/2015
KR 10-2018-0118855 A 11/2018
KR 10-2019-0055873 A 5/2019
KR 10-1981281 B1 5/2019

* cited by examiner

*Primary Examiner* — Koosha Sharifi-Tafreshi
(74) *Attorney, Agent, or Firm* — Innovation Counsel LLP

(57) ABSTRACT

A display device includes: a screen saver operable to cause an image to be displayed with a lowered luminance in a screen save mode by lowering a scale factor from a first value based on the image being displayed as a still image longer than a reference time; and an overcurrent protection circuit operable to detect an overcurrent and cause a power of the display device to be turned off based on a predetermined current value that is reduced according to the scale factor and comparison between the predetermined current value and a driving current supplied provided to a display panel in which the image is displayed.

20 Claims, 8 Drawing Sheets

DISPLAY DEVICE AND DRIVING METHOD THEREOF

CROSS-REFERENCE TO RELATED APPLICATION

This application claims priority to and the benefit of Korean Patent Application No. 10-2020-0020565 filed in the Korean Intellectual Property Office on Feb. 19, 2020, the disclosure of which is incorporated herein by reference in its entirety.

BACKGROUND

(a) Field of the Invention

The present disclosure relates to a display device and a driving method of the display device. More particularly, embodiments of the present disclosure relate to a display device including an overcurrent protection circuit and a driving method of the display device.

(b) Description of the Related Art

Among various types of display devices for displaying an image, an organic light emitting diode (OLED) display has recently attracted much attention for its advantageous characteristics over conventional display devices.

The OLED display includes an organic light emitting diode that emits light by a recombination of electrons and holes. Due to its self-emission characteristic, the OLED display does not require a separate light source, so its thickness and weight can be reduced compared to a liquid crystal display. In addition, the OLED display exhibits high quality characteristics such as low power consumption, high luminance, and a high reaction speed.

The organic light emitting diode is driven using a data voltage corresponding to an image data signal and a power supply voltage applied between its anode and cathode. During the manufacturing or in operation, a power supply line to which the power supply voltage is applied may be shorted to other wires such as a data line to which the data voltage is applied. In this case, an overcurrent may flow between a power supply and a display panel, and a damage may occur in the OLED display such as a degradation of the organic light emitting diode due to the overcurrent.

To prevent such a damage to the OLED display due to overcurrent, an overcurrent protection circuit may be used to shut down the power supply by detecting the overcurrent flowing in the power supply line.

The overcurrent protection circuit may shut down the power supply when the detected current is larger than a predetermined current value. However, if the predetermined current value of the overcurrent protection circuit is set higher than a maximum current that can flow to the display panel, the overcurrent protection circuit may not sufficiently protect the OLED display.

On the other hand, a display device may display an image in a screen save mode when the image is a still image displayed for a predetermined time or longer. In the screen save mode, the luminance of the image may be lowered to prevent an occurrence of an afterimage. When the image is displayed in the screen save mode, the current flowing through the display panel may decrease. In this case, an overcurrent may still flow in the screen save mode with a low current, and the overcurrent protection circuit may not operate as intended because the predetermined current value for determining an overcurrent is not changed when the image is displayed in the screen save mode.

The above information disclosed in this Background section is only for enhancement of understanding of the background of the present disclosure, and therefore it may contain information that does not form the prior art that is already known to a person of ordinary skill in the art.

SUMMARY

The present disclosure provides a display device and a driving method of a display device capable of adaptively operating an overcurrent protection circuit in a screen save mode.

A display device according to an exemplary embodiment of the present disclosure includes: a screen saver operable to cause an image to be displayed with a lowered luminance in a screen save mode by lowering a scale factor from a first value based on the image being displayed as a still image longer than during a reference time; and an overcurrent protection circuit operable to detect an overcurrent and cause a power of the display device to be turned off based on a predetermined current value that is reduced according to the scale factor and comparison between the predetermined current value and a driving current provided to a display panel in which the image is displayed.

The display device further includes a power supply providing the driving current to the display panel, wherein the overcurrent protection circuit provides an enable signal of an off-voltage to the power supply to shut down the power supply based on a peak duration in which the driving current is larger than the predetermined current value being longer than a reference peak duration.

The overcurrent protection circuit may transmit a return signal to the screen saver based on detection of an overcurrent in the screen save mode, and the screen saver may change the scale factor to the first value according to the return signal, and the image may be displayed in a normal mode.

The overcurrent protection circuit may set the predetermined current value as an original value in the normal mode, and compare the driving current and the predetermined current value in the normal mode to determine to cause the display device to be powered off.

The display device may further include a load calculator calculating a frame load base on a sum of a data value for a plurality of pixels of the display panel and calculating a load deviation by comparing the frame load of a previous image frame and the frame load of a current image frame, wherein the image may be displayed in the screen save mode based on the load deviation.

The image may be displayed in the screen save mode based on a duration of the load deviation being less than or equal to the reference deviation is longer than the reference time.

The screen saver may subtract a value from the scale factor for each image frame to sequentially reduce the scale factor.

The screen saver may sequentially reduce the scale factor by multiplying the scale factor by a reduction ratio for each image frame.

The screen saver may reduce the scale factor until the scale factor has a minimum scale factor value.

A driving method of a display device according to another exemplary embodiment of the present disclosure includes: monitoring a driving current provided to a display panel that displays an image; displaying the image with a lowered luminance in a screen save mode by reducing a scale factor from a first value based on the image being displayed as a still image longer than a reference time; reducing a predetermined current value according to the scale factor; comparing the predetermined current value and the driving current to detect an occurrence of an overcurrent; changing the scale factor to the first value and changing the predetermined current value to an original value to display the image in a normal mode in response to detection of the occurrence of the overcurrent in the screen save mode; and powering off the display panel based on the detection of the overcurrent based on comparison between the driving current provided to the display panel and the predetermined current value in the normal mode.

The displaying the image in the screen save mode may include sequentially reducing the scale factor by subtracting a value from the scale factor.

The displaying the image in the screen save mode may include sequentially reducing the scale factor by multiplying a reduction ratio to the scale factor.

The displaying the image in the screen save mode may include reducing the scale factor until the scale factor has a minimum scale factor value.

The display device may be powered off based on a peak duration in which the driving current is larger than the predetermined current value is longer than a reference peak duration.

The driving method of the display device may further include: calculating a frame load based on a sum of a data value for a plurality of pixels of the display panel; and calculating a load deviation by comparing the frame load of a previous image frame and the frame load of a current image frame.

The image may be displayed in the screen save mode based on a duration of the load deviation being less than or equal to a reference deviation is longer than the reference time.

The driving method of the display device may further include: determining whether the load deviation is larger than a reference deviation; and resetting the scale factor to the first value and resetting a saving count indicating a start of the screen save mode to 0 based on the load deviation being greater than the reference deviation.

The driving method of the display device may further include increasing the saving count by 1 based on the load deviation being not greater than the reference deviation.

The driving method of the display device may further include determining whether the saving count is larger than the reference time, and lowering the scale factor by a predetermined value and lowering a predetermined current value according to the scale factor based on the saving count being larger than the reference time.

Determining whether the load deviation is larger than the reference deviation, increasing the saving count by 1, determining whether the saving count is larger than the reference time, and lowering the scale factor by the predetermined value and lowering the predetermined current value according to the scale factor may be performed during a frame interrupt of one image frame and before an output of an image data signal corresponding to a next frame.

The overcurrent protection circuit adaptively operates in the screen save mode to prevent the organic light emitting diode from degraded.

DETAILED DESCRIPTION

Figure 1:
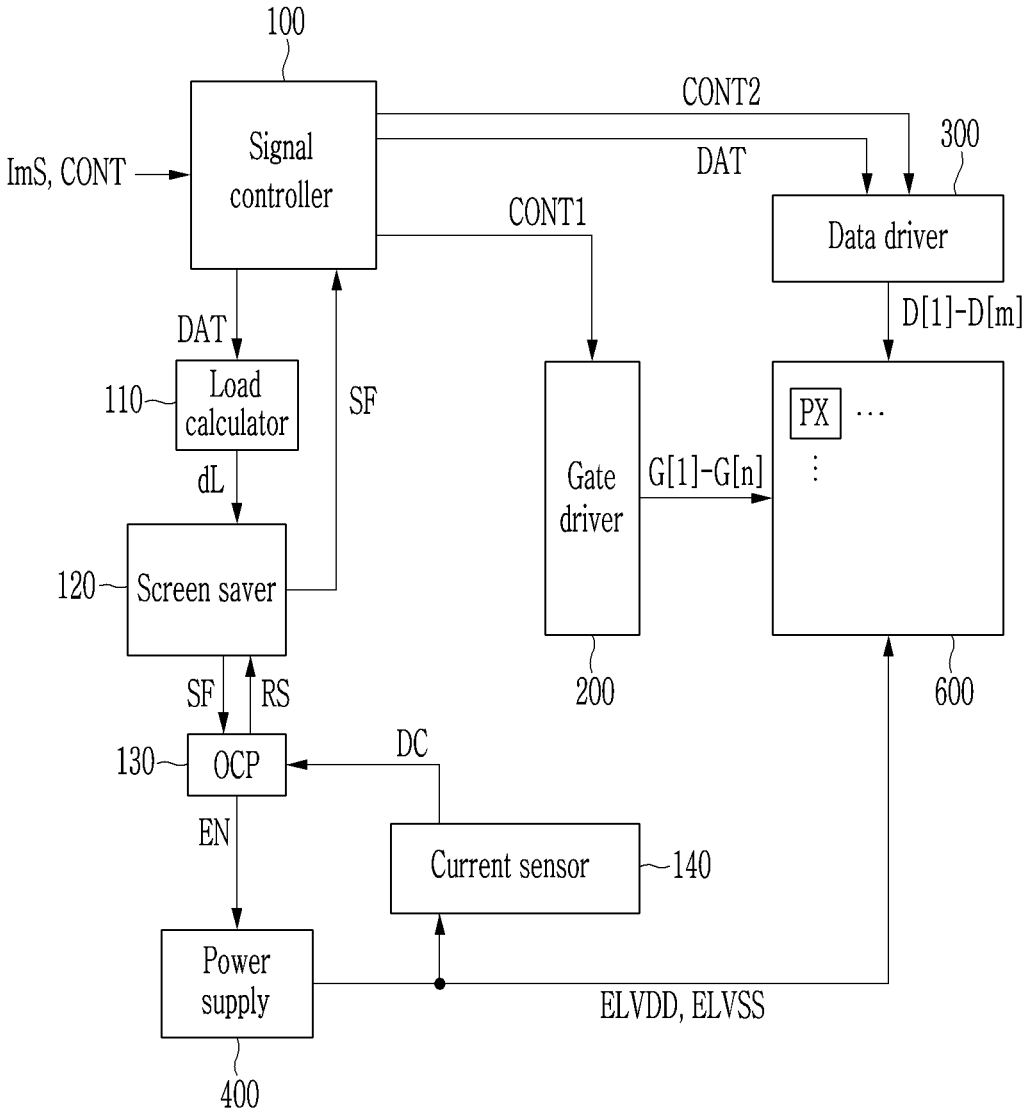
FIG. 1 is a block diagram showing a display device according to an exemplary embodiment of the present disclosure.

Embodiments of the present disclosure will be described more fully hereinafter with reference to the accompanying drawings, in which exemplary embodiments of the present disclosure are shown. As those skilled in the art would realize, the described embodiments may be modified in various forms, configuration, and ways, without departing from the spirit or scope of the present disclosure.

Further, in the exemplary embodiments, like reference numerals designate like elements having the same and/or substantially similar configuration. Elements may be representatively described in one exemplary embodiment while configurations that are different from the first exemplary embodiment will be described in other exemplary embodiments.

Accordingly, the drawings and description are to be regarded as illustrative in nature and not restrictive, and like reference numerals designate like elements throughout the specification unless it is explicitly stated otherwise.

In addition, unless explicitly described to the contrary, the word "comprise" and its variations such as "comprises" or "comprising" will be understood to imply an inclusion of stated elements but not an exclusion of any other elements.

FIG. 1 is a block diagram showing a display device according to an exemplary embodiment of the present disclosure.

Referring to FIG. 1, the display device includes a signal controller 100, a load calculator 110, a screen saver 120, an overcurrent protection (OCP) circuit 130, a current sensor 140, a gate driver 200, a data driver 300, a power supply 400, and a display panel 600.

FIG. 1 illustrates that the load calculator 110, the screen saver 120, the overcurrent protection circuit 130, and the current sensor 140 are separately provided. However, it is understood that the present disclosure is not limited thereto. For example, in some embodiments, at least one among the load calculator 110, the screen saver 120, the overcurrent protection circuit 130, and the current sensor 140 may be included in the signal controller 100. In yet another embodiment, the load calculator 110 may be included in the screen saver 120, and/or the current sensor 140 may be included in the overcurrent protection circuit 130.

The signal controller 100 receives an input image signal ImS and a control signal CONT input from an external device. The input image signal ImS includes luminance information of a plurality of pixels PX in the display panel 600. The luminance has a predetermined number of gray levels. Examples of the control signal CONT include, but are not limited to, a horizontal synchronization signal, a vertical synchronization signal, and a main clock signal.

The signal controller 100 generates a first driving control signal CONT1, a second driving control signal CONT2, and an image data signal DAT according to the input image signal ImS and the control signal CONT. The signal controller 100 may divide the input image signal ImS by a frame unit according to the vertical synchronization signal and the input image signal ImS per each gate line according to the horizontal synchronization signal, thereby generating the image data signal DAT.

In addition, the signal controller 100 receives a scale factor SF from the screen saver 120. The signal controller 100 may generate the image data signal DAT by applying the scale factor SF to the input image signal ImS. For example, the signal controller 100 may adjust the luminance of the image data signal DAT by applying the scale factor SF to the input image signal ImS.

The signal controller 100 transmits the first driving control signal CONT1 to the gate driver 200. The signal controller 100 transmits the image data signal DAT and the second driving control signal CONT2 to the data driver 300. The signal controller 100 may also transmit the image data signal DAT to the load calculator 110.

The display panel 600 may include the plurality of pixels PX to display an image. A region where the plurality of pixels PXs are arranged to display an image is referred to as a display area or a screen. The display panel 600 includes a plurality of scan lines and a plurality of data lines connected to the plurality of pixels PX. The plurality of scan lines may extend approximately in a row direction parallel to each other. The plurality of data lines may extend approximately in a column direction parallel to each other. The plurality of pixels PX may be arranged in a region where the plurality of scan lines and the plurality of data lines intersect. Depending on the structure of the plurality of pixels PX included in the display panel 600, the signal lines may be variously changed. For example, the display panel 600 may further include a plurality of sensing lines extending in the row direction, a plurality of light emitting lines extending in the row direction, and a plurality of receiving lines extending in the column direction. It is understood that the configuration of the display panel 600 is not limited to a particular example described herein.

The gate driver 200 is connected to the plurality of scan lines. The gate driver 200 generates a plurality of scan signals G[1] to G[n] according to the first driving control signal CONT1. The plurality of scan signals G[1] to G[n] may transmit a gate-on voltage or a gate-off voltage. The gate driver 200 may sequentially apply the scan signals G[1] to G[n] to the plurality of scan lines.

The data driver 300 is connected with the plurality of data lines. The data driver may sample and hold the image data signal DAT according to the second driving control signal CONT2, and apply a plurality of data voltages D[1] to D[m] to the plurality of data lines. The data driver 300 applies the data voltages D[1] to D[m] having a predetermined voltage range to the plurality of data lines corresponding to the gate-on voltage of the scan signals G[1] to G[n].

The power supply 400 generates power supply voltages ELVDD and ELVSS. The power supply voltages ELVDD and ELVSS include a first power supply voltage ELVDD and a second power supply voltage ELVSS. The first power supply voltage ELVDD and the second power supply voltage ELVSS are applied to the plurality of pixels PX of the display panel 600. The first power supply voltage ELVDD and the second power supply voltage ELVSS are voltages for driving the plurality of pixels PX. The first power supply voltage ELVDD may be a high-level voltage that is higher than the second power supply voltage ELVSS, and provides a current to an anode of each of the plurality of pixels PX. The second power supply voltage ELVSS may be a low-level voltage that is lower than the first power supply voltage ELVDD, and is applied to a cathode of each of the plurality of pixels PX.

The load calculator 110 receives the image data signal DAT and calculates a frame load from the image data signal DAT. The frame load refers to a load that is added to the display panel 600 to display an image of one frame. The frame load may be a sum of data values for the plurality of pixels PX included in the display panel 600. The load calculator 110 may calculate a load deviation dL by comparing the frame load of a previous frame with the frame load of the current frame. The load deviation dL refers to a difference between the frame load of the previous frame and the frame load of the current frame. The load calculator 110 may transfer the load deviation dL to the screen saver 120.

In another embodiment, the load calculator 110 may transmit the calculated frame load to the screen saver 120, and the screen saver 120 may calculate the load deviation dL by comparing the frame load of the previous frame with the frame load of the current frame. The screen saver 120 may cause the display device to display an image in a screen save mode based on the load deviation dL. The screen save mode includes an operation of gradually lowering the luminance of the image when a still image is displayed over a reference time. For example, the screen saver 120 monitors the load deviation dL and reduces the scale factor SF to cause the image to be displayed in the screen save mode when the load deviation dL is less than the reference deviation for a period time longer than the reference time. In one embodiment, the screen saver 120 may output the scale factor SF as 1 in a normal mode and may output the scale factor SF as a value less than 1 in the screen save mode. The screen saver 120 may sequentially decrease the scale factor SF in the screen save mode to gradually lower the luminance of the image. The screen saver 120 transmits the scale factor SF to the signal controller 100 and the overcurrent protection circuit 130.

The signal controller 100 generates the image data signal DAT by reflecting the scale factor SF that that may be sequentially decreased in the screen save mode, and the luminance of the image may be gradually lowered as the load deviation dL continue to be less than the reference deviation in the screen save mode.

The overcurrent protection circuit 130 may include a predetermined current value for detecting the overcurrent. The overcurrent protection circuit 130 may determine a current exceeding the predetermined current value as an overcurrent. In one embodiment, the overcurrent protection circuit 130 may change the predetermined current value from the original predetermined current value according to the scale factor SF. For example, the overcurrent protection circuit 130 may reduce the predetermined current value by multiplying the scale factor SF by the predetermined current value in the screen save mode. When the received scale factor SF is 1, the overcurrent protection circuit 130 may restore the predetermined current value as the original predetermined current value. As such, the predetermined current value of the overcurrent protection circuit 130 may be dynamically changed corresponding to the scale factor SF in the screen save mode.

The current sensor 140 measures a driving current DC of the power supply voltages ELVDD and ELVSS supplied to the display panel 600. The measured driving current DC is transmitted to the overcurrent protection circuit 130.

The overcurrent protection circuit 130 may cause the power of the display device turned off if the driving current DC is greater than the predetermined current value. The power off of the display device may not be determined by the process of a single comparison of the driving current DC with the predetermined current value. For example, while the driving current DC greater than the predetermined current value is maintained longer than a reference time, the overcurrent protection circuit 130 may perform the process of comparison more than once to signal the power supply 400 to turn off the power of the display device.

The overcurrent protection circuit 130 may drive the power supply 400 by providing an enable signal EN of an on-voltage to the power supply 400 in the normal mode. According to the enable signal EN of the on-voltage, the power supply 400 provides the driving current DC to the display panel 600. In a case where the driving current DC is greater than the predetermined current value over a period longer than the reference time, the overcurrent protection circuit 130 may apply the enable signal EN of an off-voltage to the power supply 400 to shut down the power supply 400.

If an overcurrent is detected in the screen save mode, the overcurrent protection circuit 130 may transmit a return signal RS to the screen saver 120. The return signal RS instructs to cancel the screen save mode and switch the display device to the normal mode. The screen saver 120 may output the scale factor SF as the original value of 1 according to the return signal RS, and the display device is switched to the normal mode. In the process of switching to the normal mode, the signal controller 100 outputs the image data signal DAT in the normal mode, and the overcurrent protection circuit 130 sets the predetermined current value to the original value. When the image is displayed in the normal mode, the overcurrent protection circuit 130 compares the driving current DC with the predetermined current value and applies the enable signal EN of the off-voltage to the power supply 400 in a case where the driving current DC is greater than the predetermined current value to shut down the power supply 400.

The overcurrent protection circuit 130 may decrease the predetermined current value in response to the luminance of the image that decreases in the screen save mode. Accordingly, in the screen save mode, the overcurrent protection circuit 130 may be adaptively operated corresponding to the lowered driving current.

Next, the driving method of the overcurrent protection circuit 130 and the screen saver 120 is described with reference to FIG. 2 to FIG. 6.

Figure 2:
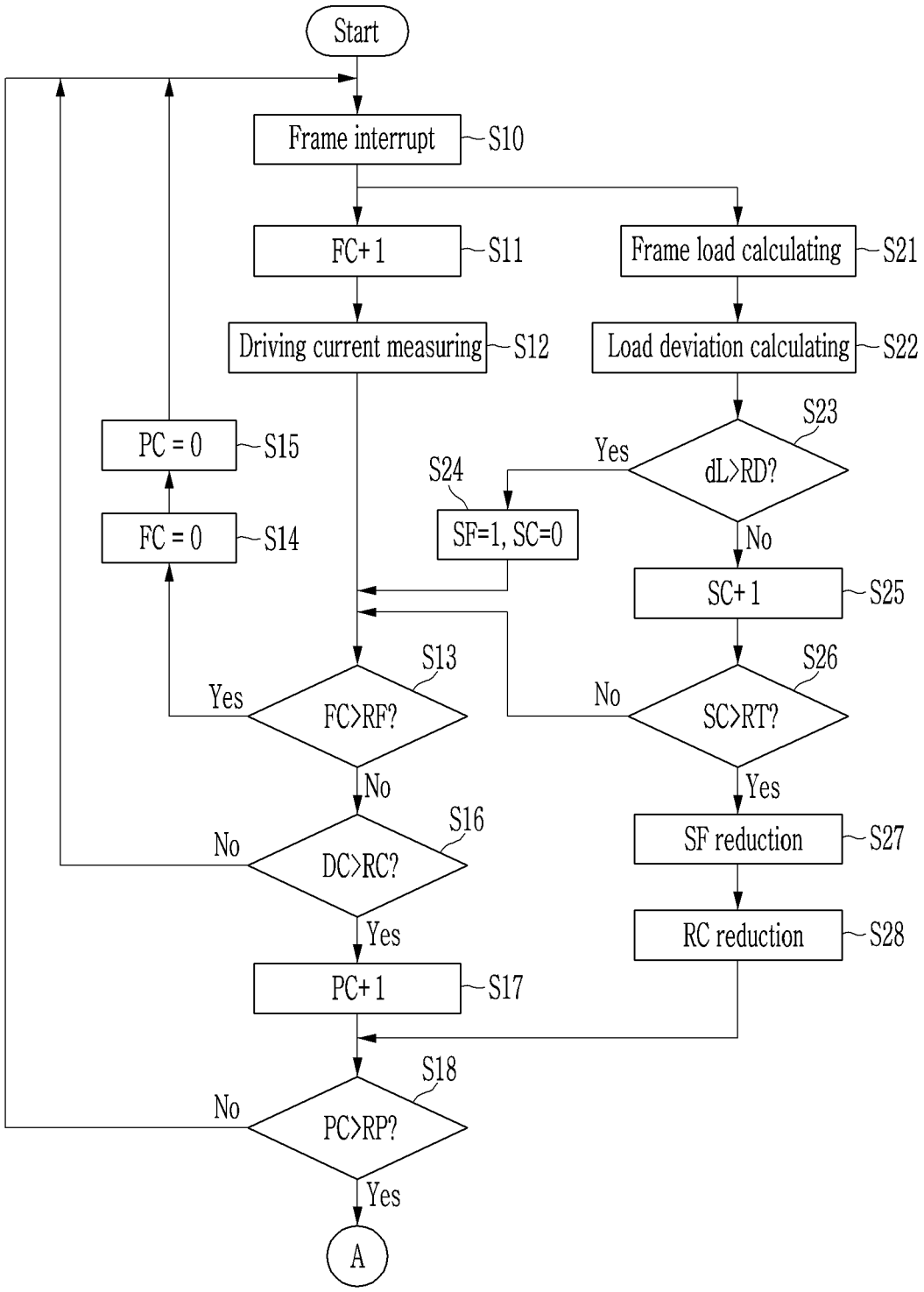
FIG. 2 is a flowchart for driving an overcurrent protection circuit and a screen saver according to an exemplary embodiment of the present disclosure.
Figure 3:
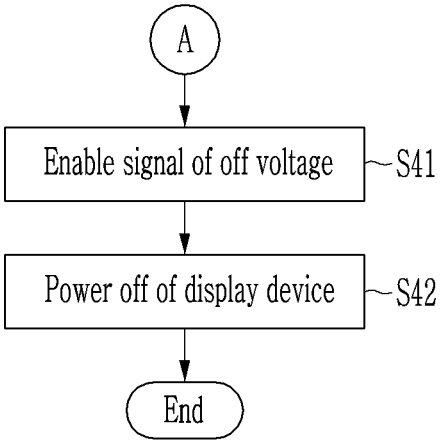
FIG. 3 is a flowchart for shutting down a power supply by an overcurrent protection circuit according to an exemplary embodiment of the present disclosure.
Figure 4:
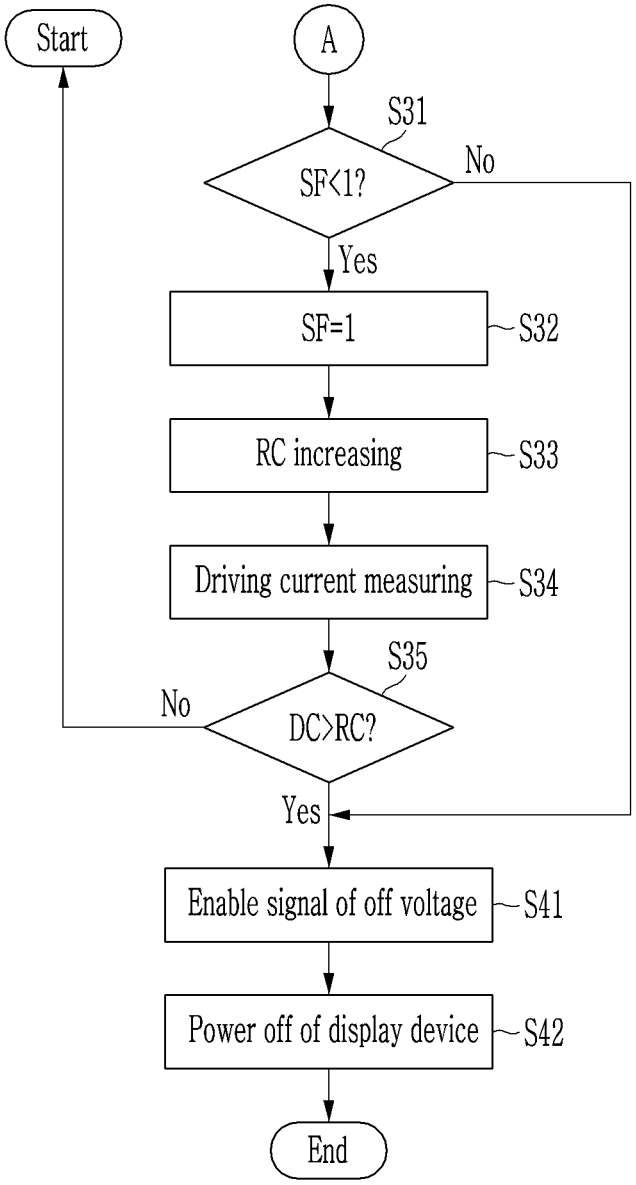
FIG. 4 is a flowchart for shutting down a power supply by an overcurrent protection circuit according to another exemplary embodiment of the present disclosure.
Figure 5:
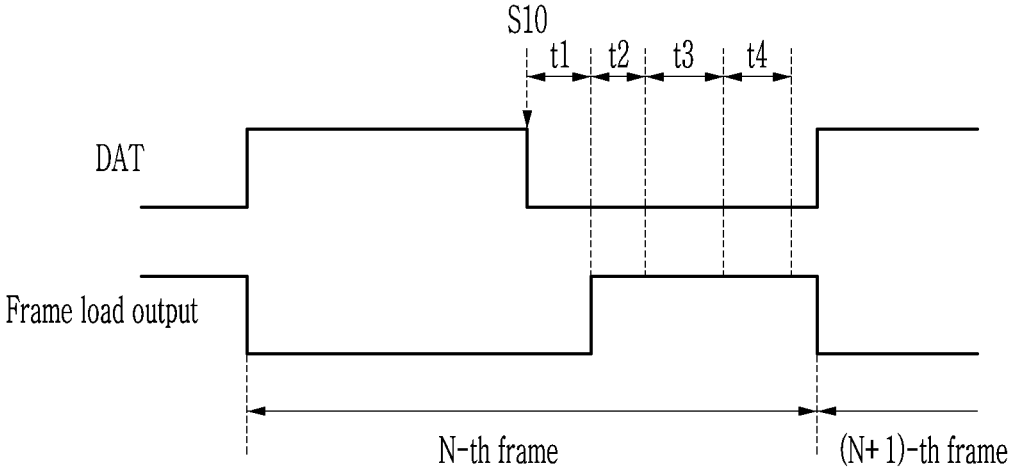
FIG. 5 is a timing diagram of a display device according to an exemplary embodiment of the present disclosure.
Figure 6:
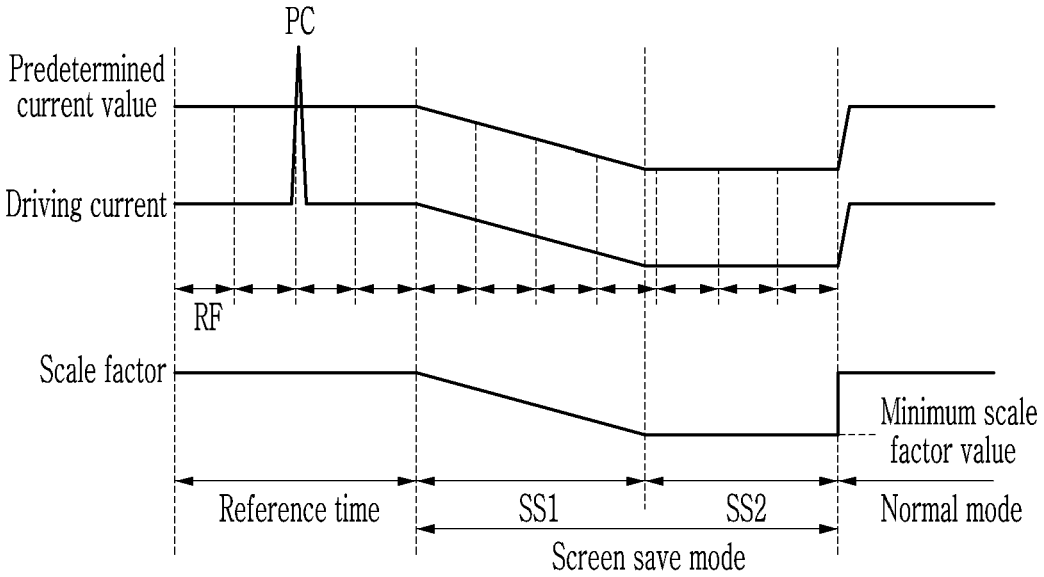
FIG. 6 is a timing diagram of a display device in a screen save mode according to an exemplary embodiment of the present disclosure.

FIG. 2 is a flowchart for driving an overcurrent protection circuit and a screen saver according to an exemplary embodiment of the present disclosure. FIG. 3 is a flowchart for shutting down a power supply by an overcurrent protection circuit according to an exemplary embodiment of the present disclosure. FIG. 4 is a flowchart for shutting down a power supply by an overcurrent protection circuit according to another exemplary embodiment of the present disclosure. FIG. 5 is a timing diagram of a display device according to an exemplary embodiment of the present disclosure. FIG. 6 is a timing diagram of a display device in a screen save mode according to an exemplary embodiment of the present disclosure.

Referring to FIG. 2, a frame interrupt is generated (S10). The frame interrupt may be generated when an output of the image data signal DAT of one frame ends.

When the frame interrupt occurs, the overcurrent protection circuit 130 increases a frame count FC by 1 (S11).

The current sensor 140 measures the driving current DC (S12). The current sensor 140 transmits the measured driving current DC to the overcurrent protection circuit 130.

The overcurrent protection circuit 130 determines whether the frame count FC is greater than a reference frame RF (S13). The reference frame RF indicates a number of frame counts for detecting an overcurrent. The reference frame RF may be predetermined. In some embodiment, the reference frame RF may represent a time period corresponding to the predetermined frame count. In this case, the frame count FC may also represent a time period. For example, the reference frame RF may be set to 600 frames or 10 seconds.

If the frame count FC is greater than the reference frame RF, the overcurrent protection circuit 130 resets the frame count FC to 0 (S14), resets a peak count PC to 0 (S15), and returns to the frame interrupt step (S10) to wait for the next occurrence of the frame interrupt. The peak count PC indicates a number of consecutive frame counts that the overcurrent protection circuit 130 determines that the driving current DC as exceeding the predetermined current value.

If the frame count FC is not greater than the reference frame RF, the overcurrent protection circuit 130 determines whether the driving current DC is greater than a predetermined current value RC (S16).

If the driving current DC is not greater than the predetermined current value RC, the overcurrent protection circuit 130 returns to the frame interrupt step (S10) to wait for the next occurrence of the frame interrupt.

If the driving current DC is greater than the predetermined current value RC, the overcurrent protection circuit 130 increases the peak count PC by 1 (S17). In this case in which the driving current DC is measured to be larger than the predetermined current value RC, the overcurrent protection circuit 130 determines this condition as a preliminary overcurrent, and the peak count PC refers to the number of occurrences of the preliminary overcurrent.

The overcurrent protection circuit 130 further determines whether the peak count PC is greater than a reference peak number RP (S18). The reference peak number RP is a consecutive number of frame counts in which preliminary overcurrent is detected for determining an occurrence of an overcurrent during the reference frame RF. The reference peak number RP may be a predetermined value representing a duration of image frames in which the driving current DC is greater than the predetermined current value RC. For example, the reference peak number RP may be determined as 5 (or 5 frame counts) to 10 (or 10 frame counts). If the peak count PC is not greater than the reference peak number RP, the overcurrent protection circuit 130 returns to the frame interrupt step (S10) to wait for the next occurrence of the frame interrupt. The overcurrent protection circuit 130 determines that an overcurrent has occurred when the peak count PC is greater than the reference peak number RP, and starts a process A for shutting down the power supply 400. The process A for shutting down the power supply 400 may be explained with reference to FIG. 3 or FIG. 4.

That is, the overcurrent protection circuit 130 may determine that an overcurrent is generated if the number of occurrences of the preliminary overcurrent is larger than the reference peak number RP during the reference frame RF, and may determine that the preliminary overcurrent occurred for a number of frame counts less than the reference peak number RP may be attributed to a noise or an insignificant artifact that does not lead to an actual overcurrent condition. For example, the overcurrent protection circuit 130 may determine that an overcurrent occurs if the preliminary overcurrent occurs 5 times during the reference frame RF of 10 seconds, and may determine that no overcurrent occurs if the preliminary overcurrent occurs less than 5 times.

On the other hand, the load calculator 110 receives the image data signal DAT, and calculates a frame load from the image data signal DAT when the frame interrupt occurs (S21). The load calculator 110 may output the calculated frame load to the screen saver 120.

The screen saver 120 compares the frame load of a previous frame (e.g., an immediate preceding frame or any previous frame within a certain frame counts) and the frame load of the current frame to calculate the load deviation dL (S22). As discussed above with reference to FIG. 1, the load calculator 110 may calculate the load deviation dL instead of the screen saver 120.

The load calculator 110 or the screen saver 120 determines whether the load deviation dL is greater than a reference deviation RD (S23). The reference deviation RD is a reference for determining that the image displayed on the display panel 600 is a still image. If the load deviation dL is greater than the reference deviation RD, the image displayed on the display panel 600 is determined to be a dynamic image (e.g., a motion picture), not a still image. If the load deviation dL is less than the reference deviation RD, it is determined that the image displayed on the display panel 600 is a still image.

If the load deviation dL is greater than the reference deviation RD, the screen saver 120 resets the scale factor SF to 1 and resets a saving count SC to 0 (S24). The saving count SC indicates the number of frame counts displaying still images. Resetting the scale factor SF to 1 indicates that maintaining the normal mode is maintained or the screen save mode is switched to the normal mode.

If the load deviation dL is not greater than the reference deviation RD, the screen saver 120 increases the saving count SC by 1 (S25).

The screen saver 120 determines whether the saving count SC is greater than a reference time RT (S26). The reference time RT is a reference time (or a frame count corresponding thereto) for starting the screen save mode. For example, the reference time RT may be set from 1 minute (or a frame count corresponding to 1 minute) to 10 minutes (or a frame count corresponding to 10 minutes), and may be variously changed by a user. If a still image is displayed in excess of the reference time RT, the display mode of the image is switched from the normal mode to the screen save mode.

If the saving count SC is greater than the reference time RT, the screen saver 120 reduces the scale factor SF to switch the display mode to the screen save mode (S27). The screen saver 120 may sequentially decrease the scale factor SF by subtracting a constant value from the scale factor SF for each frame. Alternatively, the screen saver 120 may sequentially decrease the scale factor SF by multiplying the scale factor SF by a constant reduction ratio for each frame. For example, the screen saver 120 may sequentially decrease the scale factor SF by a frame unit by subtracting 0.001 from the scale factor SF for each frame. Alternatively, the screen saver 120 may sequentially decrease the scale factor SF by a frame unit by multiplying the scale factor SF by 0.999 for each frame. The screen saver 120 may reduce the scale factor SF until the scale factor SF becomes a minimum scale factor value. The minimum scale factor value may be a predetermined value. For example, the minimum scale factor value may be set to 0.5. The screen saver 120 transmits the decreased scale factor SF to the overcurrent protection circuit 130.

The predetermined current value RC may have an original value that is preset. The overcurrent protection circuit 130 reduces the predetermined current value RC from the original value or its current value by reflecting the scale factor SF to calculate the predetermined current value RC (S28). The screen saver 120 may also transmit the reduced scale factor SF to the signal controller 100 so that the luminance of the image is lowered according to the screen save mode.

Accordingly, the luminance of the image is lowered and the predetermined current value RC of the overcurrent protection circuit 130 is lowered by the scale factor SF that is reduced in the screen save mode. In the screen save mode, the overcurrent protection circuit 130 may adaptively operate for the driving current DC that is reduced by reducing the predetermined current value RC by applying the reduced scale factor SF. Although FIG. 2 describes that the steps S13, S16, S19, S23, and S26 compare a value "greater than" another value, it is understood that the comparison may be made "equal to or greater than" depending on the definitions of the compared values and/or timing of the comparison with respect to the increment or change of the values without deviating from the scope of the present disclosure.

Hereinafter, an exemplary embodiment of the process A of shutting down the power supply 400 in an event of overcurrent is described with reference to FIG. 3 and FIG. 4.

Referring to FIG. 3, if it is determined that an overcurrent has occurred, the overcurrent protection circuit 130 applies the enable signal EN of the off-voltage to the power supply 400 regardless of the display mode of the display device (S41).

The power supply 400 is shut down by the enable signal EN of the off-voltage, and the display device is powered off (S42).

That is, the display device may be powered off regardless of the display mode of the display device displays whether it is the normal mode or the screen save mode.

Another exemplary embodiment of the process A of shutting down the power supply 400 in an event of overcurrent is described with reference to FIG. 4.

Referring to FIG. 4, if it is determined that an overcurrent has occurred, the overcurrent protection circuit 130 determines whether the scale factor SF is smaller than 1 (S31). That is, the overcurrent protection circuit 130 determines whether the display device is displaying the image in the screen save mode. If the scale factor SF is less than 1, the image is displayed in the screen save mode.

If the scale factor SF is not less than 1, or the scale factor SF is 1, the display device displays the image in the normal mode. In this case, the overcurrent protection circuit 130 applies the enable signal EN of the off-voltage to the power supply 400 (S41), and the power supply 400 is shut down by the enable signal EN of the off-voltage, and the device power is powered off (S42).

If the scale factor SF is less than 1, the display device displays the image in the screen save mode, the overcurrent protection circuit 130 transmits the return signal RS to the screen saver 120. The screen saver 120 sets the scale factor SF to 1 according to the return signal RS (S32). The screen saver 120 is switched from the screen save mode to the normal mode by transmitting the scale factor SF of 1 to the signal controller 100 and the overcurrent protection circuit 130.

In the process of switching to the normal mode, the overcurrent protection circuit 130 increases the predetermined current value RC to its original value (S33).

The signal controller 100 outputs the image data signal DAT in the normal mode.

The current sensor 140 measures the driving current DC in the normal mode (S34).

The overcurrent protection circuit 130 determines whether the driving current DC is greater than the predetermined current value RC (S35). That is, after switching to the normal mode, the overcurrent protection circuit 130 compares the driving current DC and the predetermined current value RC one more time. When the driving current DC in the normal mode is not greater than the predetermined current value RC, the overcurrent protection circuit 130 may determine that no overcurrent has occurred.

In the normal mode, if the driving current DC is larger than the predetermined current value RC, the overcurrent protection circuit 130 applies the enable signal EN of the off-voltage to the power supply 400 (S41), and the power supply 400 is shut down by the enable signal EN of the off-voltage, and the display device is powered off (S42).

As described above, when the display device displays the image in the screen save mode, the overcurrent protection circuit 130 determines one more time whether or not an overcurrent has occurred after switching to the normal mode, and the power of the display device may be turned off according to the comparison result.

Next, an operation timing of the screen saver 120 and the overcurrent protection circuit 130 described with reference to FIG. 2 to FIG. 4 is described with reference to FIG. 5.

Referring to FIG. 5, the signal controller 100 outputs the image data signal DAT per frame. The screen saver 120 and the overcurrent protection circuit 130 may perform the operation of FIG. 2 and FIG. 3 or the operation or FIG. 2 and FIG. 4 once from the frame interrupt of one frame to a start of an output of the image data signal DAT for the next frame.

For example, a frame interrupt occurs at the time that the output of the image data signal DAT is complete in the N-th frame (S10). In FIG. 5, the output of the image data signal DAT is indicated as a high level, and a low level indicates that the image data signal DAT is not output.

The process (S21) of calculating the frame load during a first period t1 may be performed following the frame interrupt.

The frame load is calculated from the image data signal DAT, and the calculated frame load may be output. In FIG. 5, the output of the frame load is indicated as having a high level.

The calculation of the screen saver 120 may be performed during a second period t2 after the frame load is output. That is, during the second period t2, a plurality of processes including the process (S22) in which the screen saver 120 calculates the load deviation dL and the process (S26) of determining whether the saving count SC is larger than the reference time RT may be performed.

To determine to switch the display mode to the screen save mode after the calculation of the screen saver 120 is performed, a process (S27) in which the screen saver 120 decreases the scale factor SF during a third period t3 and transmits the scale factor SF to the overcurrent protection circuit 130 may be performed.

The calculation of the overcurrent protection circuit 130 and the output of the enable signal EN may be performed during a fourth period t4 after the third period t3 and before the image data signal DAT for the (N+1) frame is output. That is, during the fourth period t4, the process (S28) in which the overcurrent protection circuit 130 decreases the predetermined current value RC and the process (S41) of outputting the enable signal EN of the off-voltage may be performed.

Next, the operation of the display device in the screen save mode by repeating the operations of the screen saver 120 and the overcurrent protection circuit 130 described with reference to FIG. 2 to FIG. 4 is described with reference to FIG. 6.

Referring to FIG. 6, the reference frame RF of a period in which the overcurrent protection circuit 130 detects an overcurrent may include a plurality of frames. The overcurrent protection circuit 130 may determine an occurrence of an overcurrent by calculating the peak count PC in which the driving current DC exceeds the predetermined current value RC for each frame.

In order for the screen saver 120 to start the screen save mode, the reference time RT may be greater than the reference frame RF. The reference time RT may include a plurality of reference frames RF. For example, the reference frame RF may be 600 frames or 10 seconds, and the reference time RT may be 3600 frames or 1 minute. However, it is understood that the reference frame RF and reference time RT are not limited and may be variously changed by a user.

The screen save mode includes a first screen save period SS1 and a second screen save period SS2. The first screen save period SS1 is a period in which the scale factor SF sequentially decreases for each frame. The second screen save period SS2 is a period in which the scale factor SF is maintained with the minimum scale factor value.

When a still image is displayed while exceeding the reference time RT, the image is displayed in the screen save mode, and the first screen save period SS1 is started. As the first screen save period SS1 begins, the scale factor SF may decrease sequentially from 1. The predetermined current value RC and the driving current DC may decrease in response to the decreasing scale factor SF. If the scale factor SF reaches the minimum scale factor value, the second screen save period SS2 starts.

If the load deviation dL is greater than the reference deviation RD during the first screen save period SS1 or the second screen save period SS2, the scale factor SF is reset to 1, and the display mode of the display device is switched to the normal mode. Alternatively, if it is determined that an overcurrent has occurred during one of the first screen save period SS1 and the second screen save period SS2, the scale factor SF is reset to 1, and the display mode of the display device is switched to the normal mode.

As the display mode of the display device is switched to the normal mode, the scale factor SF of 1 is applied to the image data signal DAT. Because the image data signal DAT is output in the normal mode, the driving current DC may increase. The overcurrent protection circuit 130 increases the predetermined current value RC to its original value.

Next, an exemplary embodiment of a pixel PX that may be included in the display device is described with reference to FIG. 7.

Figure 7:
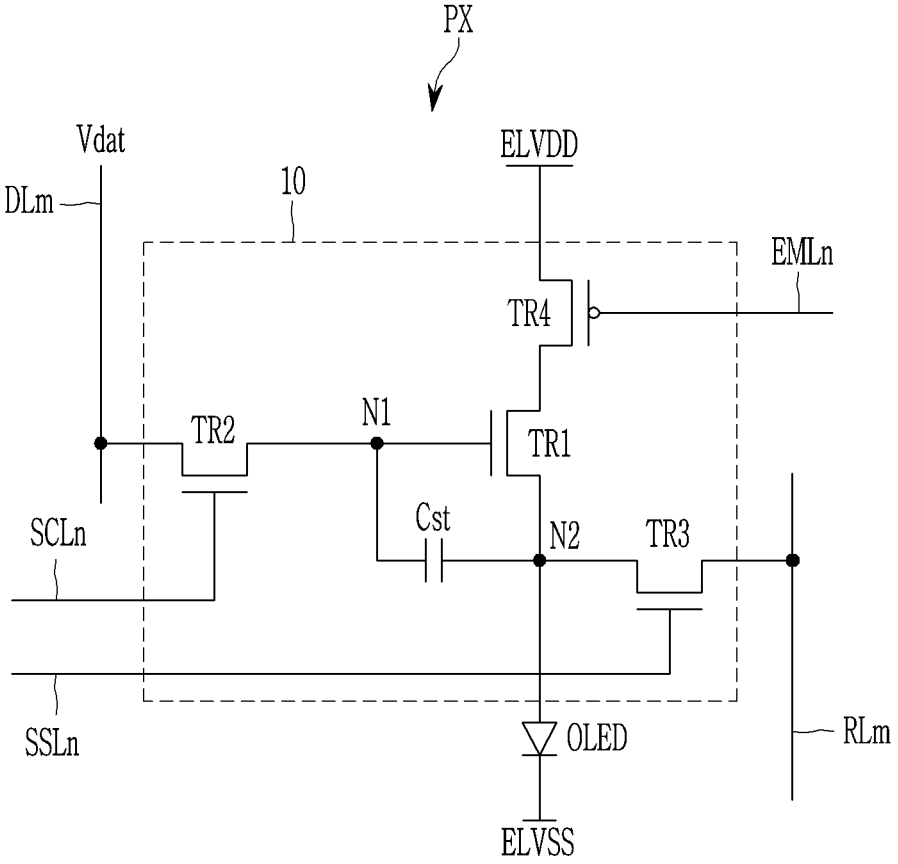
FIG. 7 is a circuit diagram showing a pixel according to an exemplary embodiment of the present disclosure.

FIG. 7 is a circuit diagram of a pixel according to an exemplary embodiment of the present disclosure. The pixel PX disposed in the n-th pixel row and the m-th pixel column (n and m being an integer greater than 1) is described as an example among a plurality of pixels PX included in the display panel 600 of FIG. 1.

Referring to FIG. 7, the pixel PX includes an organic light emitting diode (OLED) and a pixel circuit 10.

The pixel circuit 10 is configured to control a current flowing through the organic light emitting diode (OLED). The pixel circuit 10 may include a driving transistor TR1, a switching transistor TR2, a sensing transistor TR3, a light emission transistor TR4, and a storage capacitor Cst.

The driving transistor TR1 includes a gate electrode connected to a first node N1, a first electrode to which the first power supply voltage ELVDD is applied through the light emission transistor TR4, and a second electrode connected to a second node N2. The driving transistor TR1 is connected between the first power supply voltage ELVDD and the organic light emitting diode (OLED) and controls an amount of the current flowing through the organic light emitting diode (OLED) from the first power supply voltage ELVDD corresponding to the voltage at the first node N1.

The switching transistor TR2 includes a gate electrode connected to a scan line SCLn, a first electrode connected to a data line DLm, and a second electrode connected to the first node N1. The switching transistor TR2 is connected between the data line DLm and the driving transistor TR1. The switching transistor TR2 is turned on by a scan signal of the gate-on voltage applied to the scan line SCLn and transmits a data voltage Vdat applied to the data line DLm to the first node N1.

The sensing transistor TR3 includes a gate electrode connected to a sensing line SSLn, a first electrode connected to the second node N2, and a second electrode connected to a receiving line RLm. The sensing transistor TR3 is connected between the second electrode of the driving transistor TR1 and the receiving line RLm. The sensing transistor TR3 is turned on by a sensing signal of the gate-on voltage applied to the sensing line SSLn and transmits the current flowing through the organic light emitting diode (OLED) through the driving transistor TR1 to the receiving line RLm. The receiving line RLm may be used as a signal line transmitting an initialization voltage to the second node N2. The initialization voltage transmitted to the second node N2 through the receiving line RLm may initialize an anode voltage of the organic light emitting diode (OLED).

The light emission transistor TR4 includes a gate electrode connected to a light emission line EMLn, a first electrode applied with the first power supply voltage ELVDD, and a second electrode connected to the first electrode of the driving transistor TR1. The light emission transistor TR4 is turned on by a light emission signal of the gate-on voltage applied to the light emission line EMLn and transmits the first power supply voltage ELVDD to the driving transistor TR1.

The driving transistor TR1, the switching transistor TR2, and the sensing transistor TR3 may be n-channel electric field effect transistors, and the light emission transistor TR4 may be a p-channel electric field effect transistor. An n-channel electric field effect transistor may be turned on by a gate-on voltage of a high level, and turned off by gate-off voltage of a low level. A p-channel electric field effect transistor may be turned on by a gate-on voltage of a low level, and turned off by a gate-off voltage of a high level. According to an exemplary embodiment, at least one of the driving transistor TR1, the switching transistor TR2, and the sensing transistor TR3 may be a p-channel electric field effect transistor, and the light emission transistor TR4 may be an n-channel electric field effect transistor.

The storage capacitor Cst includes a first electrode connected to the first node N1 and a second electrode connected to the second node N2. The data voltage Vdat is transmitted to the first node N1 in response to the scan signal of the gate-on voltage applied to the scan line SCLn, and the storage capacitor Cst serves a function of maintaining the voltage at the first node N1.

The organic light emitting diode (OLED) includes an anode connected to the second node N2 and a cathode connected to the second power supply voltage ELVSS. The organic light emitting diode (OLED) may emit light with luminance corresponding to the current supplied from the pixel circuit 10. The organic light emitting diode (OLED) may emit light of one of primary colors or a white color. Examples of primary colors are three primary colors of red, green, and blue. Other examples of primary colors include yellow, cyan, and magenta.

Next, a driving method of the display device is described with reference to FIG. 8. The driving method described with reference to the display device of FIG. 8 may be applicable to or in conjunction with the driving method described with reference to FIG. 2 to FIG. 6.

Figure 8:
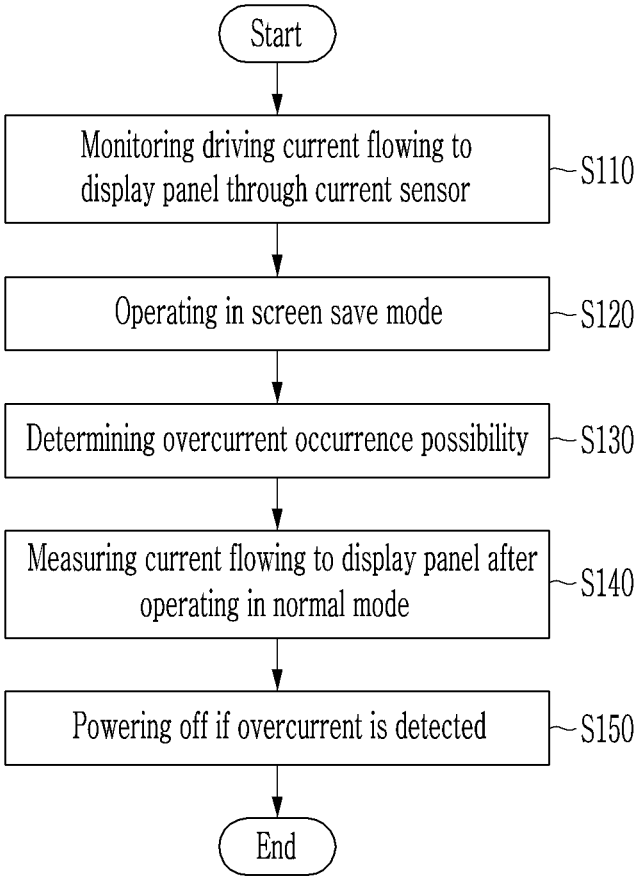
FIG. 8 is a flowchart for driving a display device according to an exemplary embodiment of the present disclosure.

FIG. 8 is a flowchart for driving the display device of FIG. 1 according to an exemplary embodiment of the present disclosure.

Referring to FIG. 8, the display device monitors the driving current DC flowing to the display panel 600 through the current sensor 140 (S110).

The display device operates in the screen save mode by reducing the scale factor SF from the first value (e.g., SF=1), and the luminance of a still image is lowered based on a duration of the still image above the reference time RT (S120).

The display device calculates the frame load based on the sum of the data values for a plurality of pixels PX from the image data signal DAT. The display device may calculate the load deviation dL by comparing the frame load of a previous frame and the frame load of the current frame. The display device may operate in the screen save mode if a duration of the load deviation dL being less than the reference deviation RD is continuous for a time longer than the reference time RT.

The display device determines whether the load deviation dL is greater than the reference deviation RD. The display device may reset the scale factor SF to a first value and reset the saving count SC to 0 when the load deviation dL is greater than the reference deviation RD.

The display device may increase the saving count SC by 1 when the load deviation dL is not greater than the reference deviation RD. The display device may reduce the scale factor SF by a predetermined value when the saving count SC is greater than the reference time RT. The display device may sequentially decrease the scale factor SF by subtracting a predetermined value from the scale factor SF. Alternatively, the display device may sequentially reduce the scale factor SF by multiplying a reduction ratio from the scale factor SF. The display device may reduce the scale factor SF until the scale factor SF reaches a predetermined minimum scale factor value.

The display device reduces the predetermined current value RC according to the scale factor SF, and compares the driving current DC and the predetermined current value RC to determine the possibility of an overcurrent event (S130).

If the driving current DC in the screen save mode is greater than the predetermined current value RC, a peak count PC is incremented, and if the peak count PC in the screen save mode is greater than a reference peak number RP (i.e., when an overcurrent is detected), the display device may be powered off.

Alternatively, if an overcurrent event is detected in the screen save mode, the display device may switch to the normal mode by changing the scale factor SF to the first value and setting the predetermined current value RC to the original value. The display device measures the driving current DC flowing to the display panel 600 in the normal mode (S140).

If the display device compares the driving current DC and the predetermined current value RC in the normal mode and an overcurrent event is detected, the display device is powered off (S150).

The above detailed descriptions with reference to the accompanying drawings are provided to assist comprehensive understanding of the exemplary embodiments of the present disclosure as defined by the claims and their equivalents. The present disclosure provides various specific details to assist the understanding, but these are to be regarded as merely exemplary. Accordingly, those of ordinary skill in the art will recognize that various changes and modifications of the embodiments described herein can be made without departing from the scope and spirit of the present disclosure. Therefore, the scope of the present disclosure shall be determined according to the present disclosure as a whole including the attached claims and the equivalents thereof.

What is claimed is:

1. A display device comprising:

a screen saver operable to cause an image to be displayed with a lowered luminance in a screen save mode by lowering a scale factor from a first value based on the image being displayed as a still image longer than a reference time; and an overcurrent protection circuit operable to detect an overcurrent and cause a power of the display device to be turned off based on a predetermined current value that is reduced according to the scale factor and comparison between the predetermined current value and a driving current provided to a display panel in which the image is displayed.

2. The display device of claim 1, further comprising a power supply providing the driving current to the display panel, and wherein the overcurrent protection circuit provides an enable signal of an off-voltage to the power supply to shut down the power supply based on a peak duration in which the driving current is larger than the predetermined current value being longer than a reference peak duration.

3. The display device of claim 1, wherein the overcurrent protection circuit transmits a return signal to the screen saver based on detection of an overcurrent in the screen save mode, and the screen saver changes the scale factor to the first value according to the return signal, and the image is displayed in a normal mode.

4. The display device of claim 3, wherein the overcurrent protection circuit sets the predetermined current value as an original value in the normal mode, and compares the driving current and the predetermined current value in the normal mode to determine to cause the display device to be powered off.

5. The display device of claim 1, further comprising a load calculator calculating a frame load based on a sum of a data value for a plurality of pixels of the display panel and calculating a load deviation by comparing the frame load of a previous image frame and the frame load of a current image frame, wherein the image is displayed in the screen save mode based on the load deviation.

6. The display device of claim 5, wherein the image is displayed in the screen save mode based on a duration of the load deviation being less than or equal to a reference deviation is longer than the reference time.

7. The display device of claim 1, wherein the screen saver subtracts a value from the scale factor for each image frame to sequentially reduce the scale factor.

8. The display device of claim 1, wherein the screen saver sequentially reduces the scale factor by multiplying the scale factor by a reduction ratio for each image frame.

9. The display device of claim 1, wherein the screen saver reduces the scale factor until the scale factor has a minimum scale factor value.

10. A driving method of a display device comprising:

monitoring a driving current provided to a display panel that displays an image;

displaying the image with a lowered luminance in a screen save mode by reducing a scale factor from a first value based on the image being displayed as a still image longer than a reference time;

reducing a predetermined current value according to the scale factor;

comparing the predetermined current value and the driving current to detect an occurrence of an overcurrent;

changing the scale factor to the first value and changing the predetermined current value to an original value to display the image in a normal mode in response to detection of the occurrence of the overcurrent in the screen save mode; and powering off the display panel based on the detection of the overcurrent based on comparison between the driving current provided to the display panel and the predetermined current value in the normal mode.

11. The driving method of the display device of claim 10, wherein the displaying the image in the screen save mode includes sequentially reducing the scale factor by subtracting a value from the scale factor.

12. The driving method of the display device of claim 10, wherein the displaying the image in the screen save mode includes sequentially reducing the scale factor by multiplying a reduction ratio to the scale factor.

13. The driving method of the display device of claim 10, wherein the displaying the image in the screen save mode includes reducing the scale factor until the scale factor has a minimum scale factor value.

14. The driving method of the display device of claim 10, wherein the display device is powered off based on a peak duration in which the driving current is larger than the predetermined current value is loner than a reference peak duration.

15. The driving method of the display device of claim 10, further comprising:

calculating a frame load based on a sum of a data value for a plurality of pixels of the display panel; and calculating a load deviation by comparing the frame load of a previous image frame and the frame load of a current image frame.

16. The driving method of the display device of claim 15, wherein, the image is displayed in the screen save mode based on a duration of the load deviation being less than or equal to a reference deviation is longer than the reference time.

17. The driving method of the display device of claim 15, further comprising:

determining whether the load deviation is larger than a reference deviation; and resetting the scale factor to the first value and resetting a saving count indicating a start of the screen save mode to 0 based on the load deviation being greater than the reference deviation.

18. The driving method of the display device of claim 17, further comprising increasing the saving count by 1 based on the load deviation being not greater than the reference deviation.

19. The driving method of the display device of claim 18, further comprising determining whether the saving count is larger than the reference time, and lowering the scale factor by a predetermined value and lowering a predetermined current value according to the scale factor based on the saving count being larger than the reference time.

20. The driving method of the display device of claim 19, wherein determining whether the load deviation is larger than the reference deviation, increasing the saving count by 1, determining whether the saving count is larger than the reference time, and lowering the scale factor by the predetermined value and lowering the predetermined current value according to the scale factor are performed during a frame interrupt of one image frame and before an output of an image data signal corresponding to a next image frame.

* * * * *